US008220179B2

(12) United States Patent
Maruyama et al.

(10) Patent No.: US 8,220,179 B2
(45) Date of Patent: Jul. 17, 2012

(54) DISC DRYING DEVICE AND DISC DRYING METHOD

(75) Inventors: Makoto Maruyama, Kamisato (JP); Brian Rattray, Kamisato (JP)

(73) Assignee: Hitachi High-Technologies Corporation, Tokyo (JP)

( * ) Notice: Subject to any disclaimer, the term of this patent is extended or adjusted under 35 U.S.C. 154(b) by 224 days.

(21) Appl. No.: 12/795,964

(22) Filed: Jun. 8, 2010

(65) Prior Publication Data

US 2010/0319210 A1 Dec. 23, 2010

(30) Foreign Application Priority Data

Jun. 19, 2009 (JP) ..... 2009-146118

(51) Int. Cl.
*F26B 5/08* (2006.01)
*F26B 17/30* (2006.01)

(52) U.S. Cl. ..... 34/312; 34/317; 34/348; 34/357; 34/389; 34/58; 34/60

(58) Field of Classification Search ..... 34/312, 34/317, 329, 348, 357, 380, 389, 58, 60, 34/61, 69
See application file for complete search history.

(56) References Cited

FOREIGN PATENT DOCUMENTS

JP 2001-216634 8/2001
JP 2003234323 A * 8/2003

* cited by examiner

*Primary Examiner* — Jiping Lu
(74) *Attorney, Agent, or Firm* — Brundidge & Stanger, P.C.

(57) ABSTRACT

The present invention provides a disc drying device and a disc drying method that allow simultaneous and quick drying of plural discs by a batch process and realize miniaturization of the device. In the present invention, plural discs arranged along a single axis are simultaneously chucked at outer peripheries thereof so that central openings of the discs internally form a space; plural nozzles are disposed in the space so as to supply hot water from inner peripheral surfaces of two sides of each of the discs to heat the discs with the hot water; and the discs are simultaneously rotated to thereby move the hot water from inner peripheries to outer peripheries of the discs and discharge the hot water outwardly of the outer peripheries by centrifugal force. The discharged hot water flows through valley grooves provided in inner wall surfaces of a water receiving cover to the lower side of the discs to be discharged to the outside.

10 Claims, 4 Drawing Sheets

DISC DRYING DEVICE AND DISC DRYING METHOD

BACKGROUND OF THE INVENTION

1. Field of the Invention

The present invention relates to a disc drying device and a disc drying method, and more particularly, to a disc drying device that allows simultaneous and quick drying of plural discs by a batch process and miniaturization of the device.

2. Description of the Related Art

In the case of substrates for magnetic discs (hard discs) as information recording media, cleaning of the discs has been performed after the process of grinding, polishing, spattering and plating. For the cleaning of hard discs and substrates therefor (hereinafter these will be simply referred to as discs), plural cleaning processes and drying processes after the cleaning are provided.

Typically, the drying process is independent of the cleaning process. The discs after cleaning are immersed in a pure water container and then taken out therefrom to be subjected to the drying process so as to prevent cleaning liquid from remaining after the drying. In that case, the simultaneous handling of multiple discs, the drying processing during the delivery of the discs after cleaning and the like, are performed in order to enhance the throughput from cleaning to drying of the discs.

Such drying process is included in the disc cleaning processing in a broad sense, and devices have been known in which the cleaning and drying of discs are performed at the same time. As one of such devices, Japanese Published Unexamined Patent Application No. 2001-216634 discloses a disc cleaning and drying device using a spin-dry method in which discs are rotated to eliminate fluid adhering to the discs by centrifugal force and then the fluid is received by a rotating through-hole cover to be discharged to the outside.

SUMMARY OF THE INVENTION

In the related art, however, when drying the discs after cleaning, there has been a need to transfer the discs in wet condition to the drying process. For this reason, dirt is likely to adhere to the discs in wet condition in the delivery process for transferring to the drying process. In addition, since the recent drying process includes a rinsing process and a spin-drying process, there has been a problem that dirt also adheres to the discs in the delivery process for transferring from the rinsing process to the spin-drying process.

Further, the discs are chucked at the time of delivery, or, in a chucked state, the discs in wet condition are taken in and out from one bath to another or from one processing chamber to another. Even when the amount of time for the taking in and out is minimized, it takes about five to six seconds. This processing time causes a decrease in throughput of the whole disc cleaning processing including drying.

According to the disc cleaning and drying device disclosed in Japanese Published Unexamined Patent Application No. 2001-216634, continuous processing of the cleaning process and the spin-drying process is performed without handling the discs, thereby allowing a reduction in processing time for the whole cleaning processing. In such a disc cleaning and drying device, however, the number of processable discs is limited to two or three at a time, and cleaning processing efficiency per disc is not much improved. Additionally, one problem is that, to process multiple discs at a time in such a device, upsizing of the device is required. Of course, also in the case where the disc drying device is independently provided, the drying device must be upsized to perform the drying processing of multiple discs at a time.

Accordingly, the present invention addresses the above-described problems in the related art, and an object of the invention is to provide a disc drying device that allows simultaneous and quick drying of plural discs by a batch process and miniaturization of the device.

It is another object of the invention to provide a disc drying method for simultaneously and quickly drying plural discs by a batch process.

A feature of a disc drying device and a disc drying method according to the present invention for achieving such object includes: simultaneously chucking, with a disc chuck mechanism, outer peripheries of plural the discs erected with respective centers of the discs arranged along a single axis, leaving a predetermined space therebetween; externally and removably covering the plural chucked discs with a cylindrical water receiving cover with valley grooves being formed circumferentially in a plane perpendicular to the cylindrical axis in an inner wall surface of the water receiving cover; inserting plural pairs of nozzles, in a removable manner with respect to the discs, into a space formed by the central openings of the chucked discs, and placing each of the pairs of nozzles corresponding to two sides of an inner peripheral surface adjacent to the central opening of each of the discs; rotating the disc chuck mechanism to rotate, about the centers of the discs, the discs with the pairs of nozzles and the water receiving cover mounted, and supplying hot water from the pairs of nozzles to heat the chucked discs; causing the hot water to flow from the inner peripheral surfaces to the outer peripheries of the discs by centrifugal force and to be outwardly discharged; and causing the discharged hot water to flow through the valley grooves and to be discharged to the outside from the water receiving cover.

According to an aspect of the present invention, plural discs arranged along a single axis are simultaneously chucked at outer peripheries thereof so that central openings of the discs internally form a space; plural nozzles are disposed in the space so as to supply hot water from inner peripheral surfaces of two sides of each of the discs to heat the discs with the hot water; and the discs are simultaneously rotated to thereby move the hot water from inner peripheries to outer peripheries of the discs and discharge the hot water outwardly of the outer peripheries by centrifugal force.

The discharged hot water flows through valley grooves provided in inner wall surfaces of a water receiving cover to the lower side of the discs to be discharged to the outside. Thus, it is possible to prevent the hot water from dripping on the discs during or after cleaning of the discs and to quickly dry by heating, after stopping the hot water, the discs heated along with the dirt cleaning.

Furthermore, in the case of shallow valley grooves or the like, or, depending on the shapes of the valley grooves, fins for preventing the hot water from dripping may be provided on both sides of an upper surface of each valley groove. Preferably, the fins are provided over a semicircle or a larger portion of the cylinder of the water receiving cover.

With this structure, the hot water after cleaning and heating peripherally discharged by centrifugal force is received and guided by the valley grooves formed in the inner wall surface of the cylindrical water receiving cover to be discharged to the outside from the lower side of the water receiving cover.

Also, the pairs of nozzles are inserted into the space formed by the central openings of the chucked discs in such a manner that the pairs of nozzles are removably mounted on the discs along with the water receiving cover. This allows miniaturization of the whole drying device.

The arrangement may be such that there is further provided an advancing/retreating mechanism for advancing and retreating the nozzles and the water receiving cover along the single axis with respect to the chucked discs. With this structure, the discs are retreated from the disc chuck mechanism, thereby facilitating loading and unloading of the discs from the disc chuck mechanism. Thus, the efficiency of a batch process may be improved.

Accordingly, it is possible to realize the disc drying device that allows simultaneous and quick drying of the plural discs by the batch process and is small-sized.

These and other objects, features and advantages of the invention will be apparent from the following more particular description of a preferred embodiment of the invention, as illustrated in the accompanying drawings.

DESCRIPTION OF THE PREFERRED EMBODIMENTS

Figure 1A:
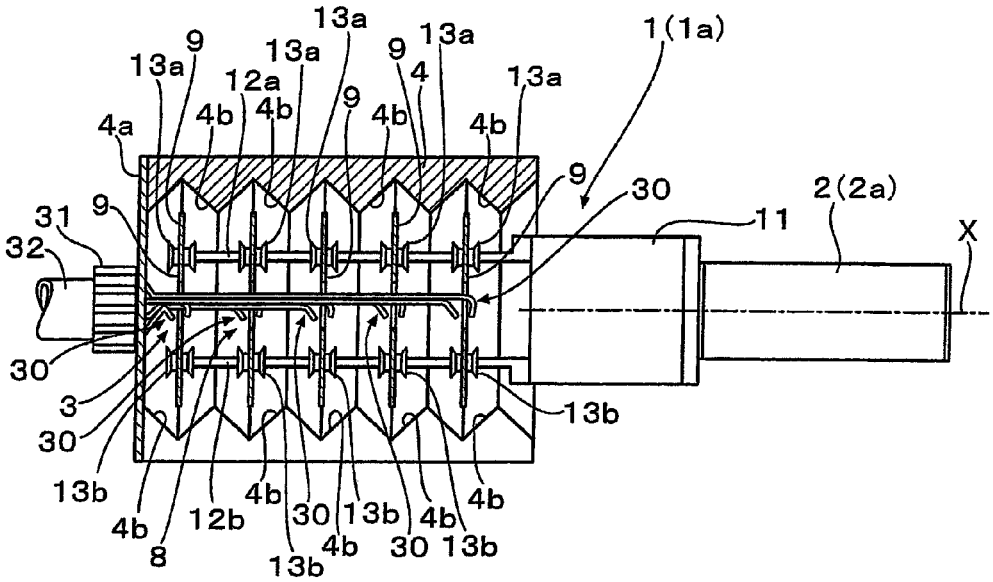
FIG. 1A is a side sectional view for explaining the drying principle of a disc drying device.
Figure 3:
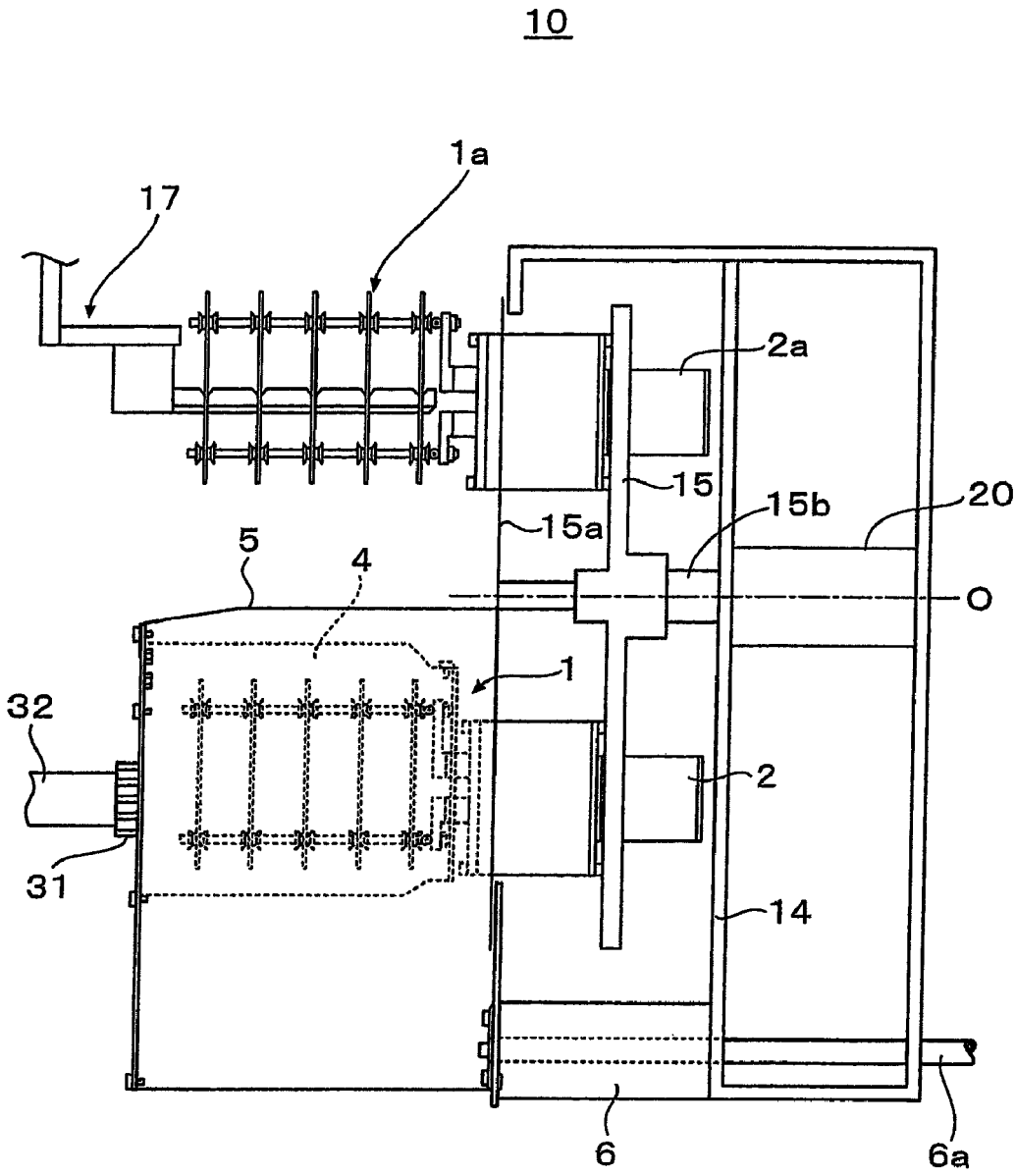
FIG. 3 is a sectional explanatory view, with the water receiving cover mounted, of a disc drying device according to one embodiment of the present invention.

In FIG. 3, reference sign 10 denotes a disc drying device; 1 and 1*a* denote disc chuck mechanisms of the disc drying device 10; 2 and 2*a* denote rotary drive mechanisms (drive motors) of the disc chuck mechanisms 1 and 1*a*; 3 denotes a hot-water supply nozzle unit (see FIG. 1A); 4 denotes a water receiving cover (see FIG. 1A); 5 denotes an enclosure; 6 denotes a water receiving cover advancing/retreating mechanism; and 9 denotes a disc (see FIG. 1A).

Figure 1B:
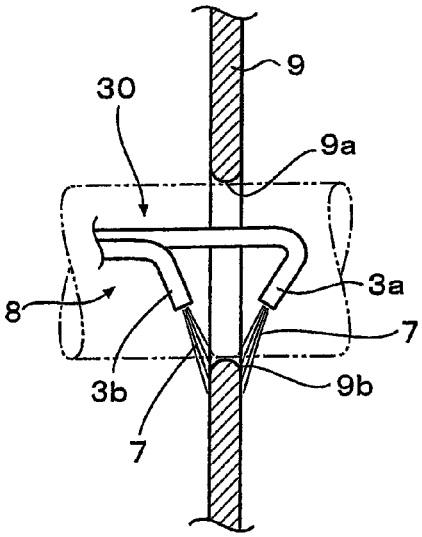
FIG. 1B is an explanatory view of a hot water supplying portion of FIG. 1A.
Figure 1C:
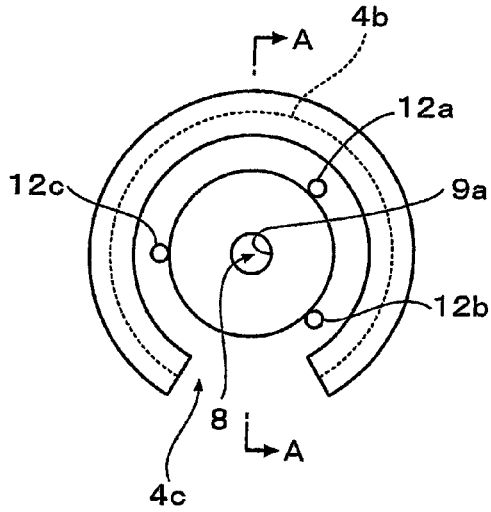
FIG. 1C is a front schematic view of FIG. 1A.

Referring to FIGS. 1A to 1C, the disc chuck mechanism 1 is composed of a chuck opening and closing mechanism 11 and three chuck arms 12*a*, 12*b*, and 12*c*, and holds the five (plural) discs 9 using an outer circumferential three-point chuck (see FIG. 1C), with the discs 9 being erected with respective centers thereof arranged along X axis, leaving a predetermined space therebetween.

It should be noted that FIG. 1A is a sectional view taken along the arrowed line A-A of FIG. 1C and therefore the chuck arm 12*c* does not appear in FIG. 1A.

The chuck arms 12*a*, 12*b*, and 12*c* are respectively provided with five respective chuck rollers 13*a*, 13*b*, and 13*c* for simultaneously chucking the five discs 9, corresponding to outer peripheries of the five discs 9 arranged and erected leaving a predetermined space therebetween. It should be noted that the chuck roller 13*c* does not appear in FIG. 1A, in the same manner as the chuck arm 12*c*.

As shown in FIG. 1A, the five respective chuck rollers 13*a*, 13*b*, and 13*c* are provided on the chuck arms 12*a*, 12*b*, and 12*c*, respectively, leaving predetermined spaces corresponding to the outer peripheries of the respective arranged discs 9.

The respective chuck arms 12*a*, 12*b*, and 12*c* of the disc chuck mechanism 1 are rotated about the center of the discs 9 by the rotary drive mechanism 2 to thereby simultaneously rotate the five discs 9.

The hot-water supply nozzle unit 3 is constructed by bundling five nozzles 30 each composed of a pair of nozzles 3*a* and 3*b* shown in FIG. 1B. The pair of nozzles 3*a* and 3*b* of each of the five nozzles 30 jet hot water 7 toward inner peripheral surfaces of the two sides of each disc 9.

The hot-water supply nozzle unit 3 is inserted from the outside into an internal space 8 (see FIGS. 1A to 1C) formed by a central opening 9*a* (see FIGS. 1B and 1C) of the disc 9, and the nozzles 3*a* and 3*b* are placed corresponding to inner peripheral surfaces 9*b* of each of the five discs 9. Thus, the five nozzles 30 are provided in a bundled manner, in such a manner as to be displaced leaving predetermined spaces corresponding to the predetermined spaces of the discs 9 (see FIG. 1A).

A connector pipe 31 (see FIG. 1A) is provided on a bundled end portion of the hot water supply nozzle unit 3. The connector pipe 31 is fixed to a closed bottom 4*a* (see FIG. 1A) of the water receiving cover 4 as shown on the left side of the figure. The connector pipe 31 is connected to a hot water supply pipe 32, and the hot water 7 is supplied to the five nozzles 30 from the outside through the connector pipe 31.

In FIG. 1C, the hot water supply nozzle unit 3 located on the bottom 4*a* and the bottom 4*a* are removed for convenience of explanation for the water receiving cover 4 and a chucked state of the disc 9.

The hot water supply nozzle unit 3 is advanced and retreated with respect to the disc chuck mechanism 1 along with the water receiving cover 4 by the drive of the water receiving cover advancing/retreating mechanism 6 (see FIGS. 2 and 3) to be mounted and removed on and from the five chucked discs 9. When the hot water supply nozzle unit 3 is advanced to be mounted on the five discs 9, the hot water supply nozzle unit 3 is disposed within the internal space 8 formed by the central openings 9*a* as shown in FIG. 1A, and the nozzles 3*a* and 3*b* are placed to face the two sides of the inner peripheral surface 9*b* of each of the five discs 9 (see FIG. 1B). At this time, the five nozzles 30 are located slightly downward from the center of the central openings 9*a*.

The water receiving cover 4 is, as shown in FIGS. 1A and 1C, a bottomed cylindrical member, having the bottom 4*a*, with a side surface for covering the five chucked discs 9 partially opened in a slit shape along the central axis of the cylinder (see an opened side surface 4*c* in FIG. 10). In inner wall surfaces of the water receiving cover 4, five (plural) valley grooves 4*b* corresponding to the outer peripheries of the five (plural) discs 9 for receiving the hot water 7 discharged outwardly of the outer peripheries, are circumferentially formed perpendicular to the cylinder axis, leaving a predetermined space therebetween.

As shown in FIG. 1C, the opened side surface 4*c* of the water receiving cover 4 is formed by opening a portion of the water receiving cover 4 corresponding to the lower side of the five erected discs 9 along the cylinder axis X so as to discharge the hot water 7 flowing through the valley grooves 4*b* of the water receiving cover 4, and serves as a discharge opening of the water receiving cover 4.

The opened side surface 4*c* is formed from the top face to the bottom of the cylinder along the cylinder central axis on the side surface of the water receiving cover 4. However, since it is only necessary to allow discharge of the hot water 7, the opened side surface 4*c* may be provided on a portion of the side surface of the water receiving cover 4 or alternatively, may be provided as an inclined groove for discharge.

It should be noted that since the head of the water receiving cover 4 is opened, the opened side surface 4*c* is not necessarily required. Moreover, the opened side surface 4*c* does not have to be provided as a slit-like opening on a side surface along the cylinder axis of the water receiving cover 4, but the discharge opening may be formed in any shape.

The disc chuck mechanism 1 is rotated about the center of the five discs 9 by the rotary drive mechanism 2. When the disc chuck mechanism 1 is rotated, the hot water 7 jetted to the respective inner peripheral surfaces of the five discs 9 is guided from the inner peripheries to the outer peripheries of the five discs 9 by centrifugal force to be discharged further outwardly from the outer peripheries. At this time, the five discs 9 are heated by the hot water 7. Thus, when the hot water 7 is stopped after the completion of cleaning, the heated discs 9 can be quickly air-dried.

The outwardly discharged hot water 7 is received by the valley grooves 4*b* of the water receiving cover 4 provided corresponding to the respective outer peripheries of the five discs 9, outside of the outer peripheries. And then, the hot water 7 flows through the valley grooves 4*b* and is discharged from the opened side surface 4*c* to fall to the enclosure 5 (see FIGS. 2 and 3).

Figure 2:
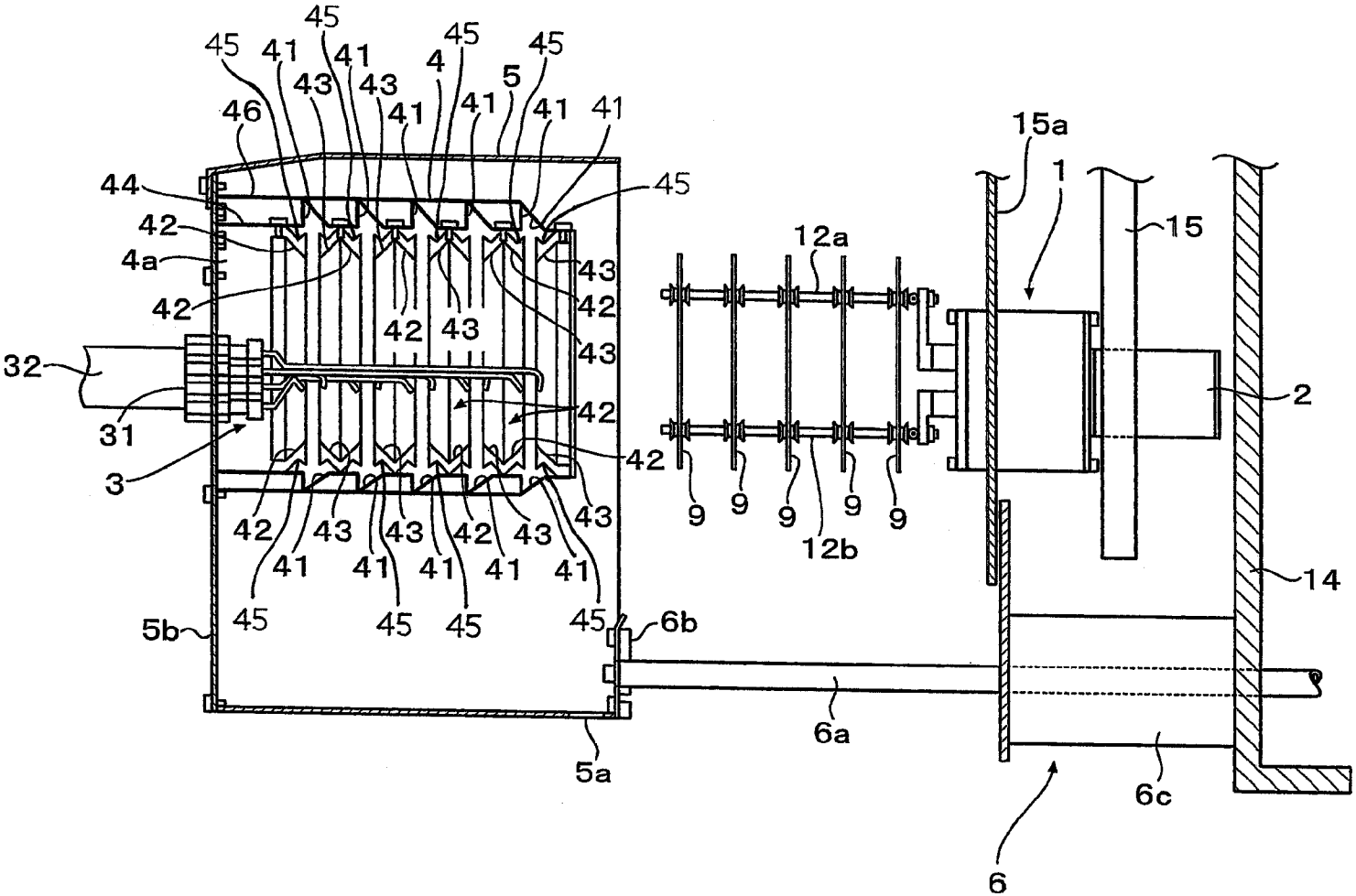
FIG. 2 is a sectional view for explaining a hot water supply nozzle unit without a water receiving cover and the water receiving cover according to one embodiment of the present invention.

The enclosure 5 is, as shown in FIG. 2, a bottomed cylinder that is one size larger than the water receiving cover 4, and a discharge opening 5*a* is provided in a side surface on the floor side of the enclosure 5.

FIG. 2 is a sectional view for explaining the hot water supply nozzle unit without the water receiving cover and the water receiving cover according to one embodiment of the present invention.

According to this embodiment, the hot water supply nozzle unit 3 and the bottom 4*a* of the water receiving cover 4 are fixed to a bottom 5*b* of the enclosure 5 as shown on the left side of the figure. Also, an arm 6*a* of the water receiving cover advancing/retreating mechanism 6 is coupled to an opened head portion of the enclosure 5 through a bracket 6*b*, and configured to advance/retreat the hot water supply nozzle unit 3, the water receiving cover 4, and the enclosure 5 at the same time.

In this embodiment, valley grooves 41, each composed of two sides of a triangle including a vertical side, are formed by changing the V-shape of the valley grooves 4*b*. Fins 42 and 43 for preventing water from dripping are provided along the valley grooves 41 on both sides of each of the valley grooves 41.

The water receiving cover 4 is composed of a water receiving cylindrical body 44 with the valley grooves 41 formed on the inside thereof by forming a metallic plate into an accordion shape, and the fins 42 and 43. The fins 42 and 43 are formed with fin rings 45 V-shaped in section for forming the fins 42 and 43 thereon being disposed corresponding to portions between the valley grooves 41 to be attached to inner wall surfaces of the water receiving cylindrical body 44 having the valley grooves 41 and bolted from the outside. The water receiving cover 4 is formed with the water receiving cylindrical body 44 externally covered with an outer peripheral cover 46.

It should be noted that the first and last fin rings 45 are formed with the V-shaped section vertically cut in half, and therefore only either one of the fins 42 and 43 is formed thereon.

In the meantime, the water receiving cover advancing/retreating mechanism 6 is composed of the advancing/retreating arm 6*a* attached to a lower side portion of the enclosure 5, the bracket 6*b*, and an x-direction advancing/retreating drive mechanism 6*c*. The x-direction advancing/retreating drive mechanism 6*c* is fixed to a device frame 14.

FIG. 3 is a side sectional view for explaining a drying operation condition of the disc drying device with the water receiving cover mounted.

The disc chuck mechanism 1 is fixed to an erected turning table 15 through the rotary drive mechanism 2. A cover disc 15*a* is provided in front of the turning table 15. The turning table 15 includes, as shown in FIG. 3, a rotary shaft 15*b* journaled to the erected device frame 14, and is rotationally driven by a drive motor 20.

As shown in FIG. 3, the turning table 15 is provided with another disc chuck mechanism 1*a* above the disc chuck mechanism 1. These two disc chuck mechanisms 1 and 1*a* are laterally provided on the turning table 15, at a predetermined angle with respect to rotation center O of the turning table 15. Thus, the turning table 15 is rotated in a vertical plane about the rotation center O of the turning table 15, thereby allowing the two disc chuck mechanisms 1 and 1*a* to face alternately the water receiving cover 4.

Figure 4A:
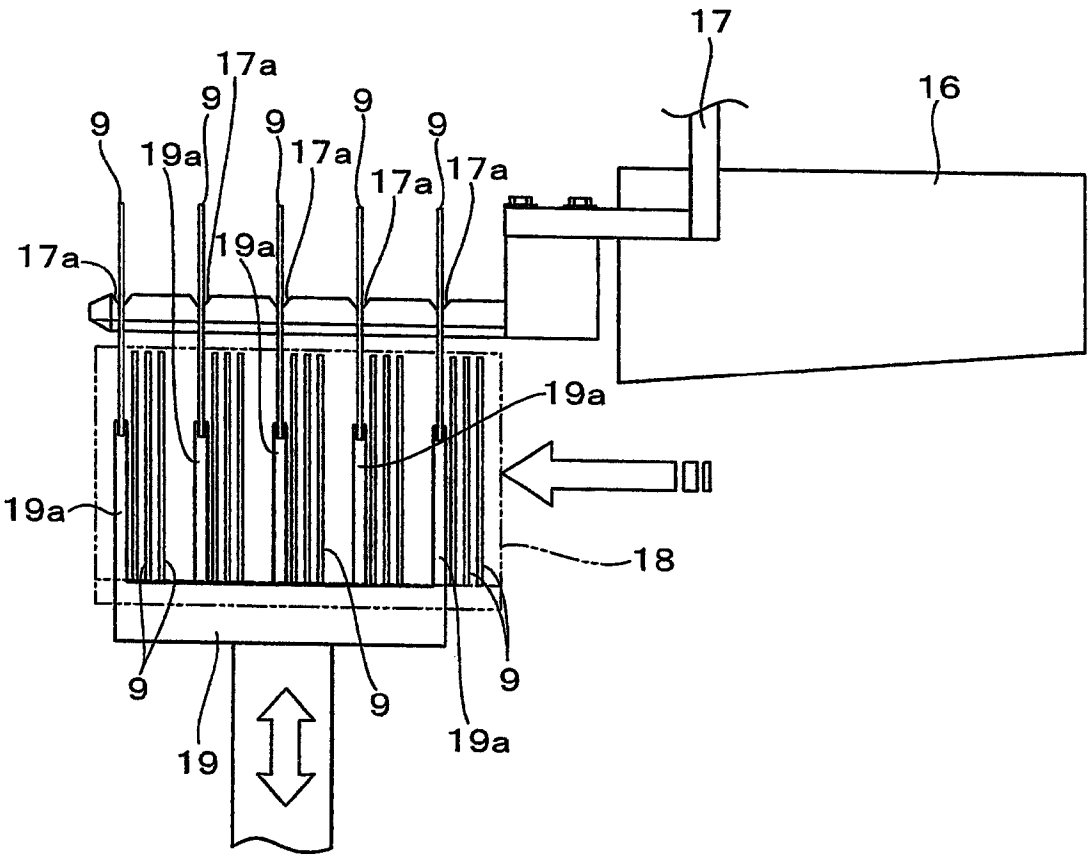
FIG. 4A is an explanatory view of a handling robot that simultaneously picks up plural discs from a disc cassette.
Figure 4B:
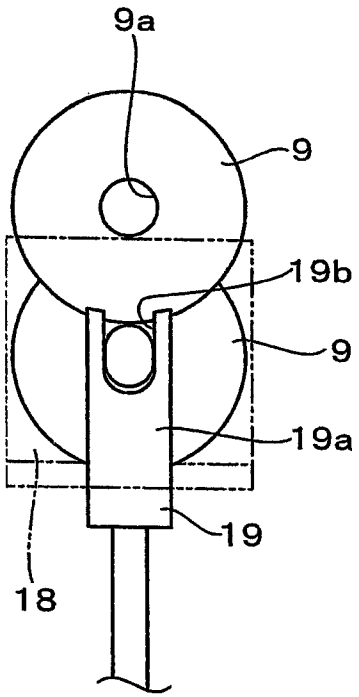
FIG. 4B is an explanatory view of the relation between the discs and a disc lifter.

The upper disc chuck mechanism 1*a* exchanges, at this position, the five discs 9 with a pickup arm 17 of a handling robot 16 (see FIG. 4). FIG. 3 illustrates a state where the five discs 9 are simultaneously unloaded from the disc chuck mechanism 1*a* or loaded on the disc chuck mechanism 1*a* after the unloading.

As shown in FIG. 4A, the pickup arm 17 of the handling robot 16 simultaneously picks up the five discs 9 or simultaneously stores the five picked-up discs 9 in a cassette 18.

FIG. 4A is an explanatory view of the handling robot 16 that simultaneously picks up the five discs 9 from the disc cassette 18.

The five discs 9 stored in the cassette 18 shown by a two-dot-dash line are lifted, leaving a predetermined space, from the cassette 18 by a disc lifter 19 moving up and down. The disc lifter 19 is provided with five support teeth 19*a* in a comb-teeth shape, leaving a predetermined space therebetween. A V-shaped or U-shaped groove 19*b* for receiving the rim of the disc 9 is cut in an edge of each of the support teeth 19*a*.

The central openings 9*a* of the five discs 9 upwardly protruded from the cassette 18 by the disc lifter 19 are located above the cassette 18. The pickup arm 17 of the handling robot 16 is introduced from the side through the central openings 9*a* of the five discs 9 lifted up in this state to be raised, thereby simultaneously hanging the five discs 9 thereon.

V-shaped grooves 17*a* are cut in disc hanging positions on the pickup arm 17, leaving predetermined spaces corresponding to the arrangement of the discs 9. Also, in the bottom of the cassette 18, there are provided openings (not shown) in which the support teeth 19*a* of the disc lifter 19 are put.

The above describes the state in which the five discs are picked up from the cassette 18. When storing the five discs in the cassette 18, on the other hand, the pickup arm 17 descends with the five discs aligned with empty disc-storing positions of the cassette 18 and then the raised disc lifter 19 receives the five discs to descend, that is, the reverse action of the above.

The present invention has been described in terms of one embodiment in which the plural pairs of nozzles and the water receiving cover are relatively advanced and retreated along the single axis with respect to the disc chuck mechanism to be thereby retracted outside of the location of the plural chucked discs. However, the present invention may include the configuration in which the plural pairs of nozzles and the water receiving cover are removably mounted on the plural chucked discs.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A disc drying device for spin-drying a disc having a central opening, comprising:

a disc chuck mechanism for simultaneously chucking outer peripheries of a plurality of the discs erected with respective centers of the discs arranged along a single axis, leaving a predetermined space therebetween;

a water receiving cover of a cylindrical shape, for externally covering the plurality of chucked discs, the water receiving cover with valley grooves being formed corresponding to the outer peripheries of the chucked discs, circumferentially in a plane perpendicular to the cylindrical axis, in an inner wall surface of the water receiving cover; and a plurality of pairs of nozzles provided corresponding to the plurality of discs for heating the chucked discs, the pairs of nozzles being disposed inside a space formed by the central openings to supply hot water to two sides of an inner peripheral surface adjacent to the central opening of each of the discs, the pairs of nozzles and the water receiving cover being removably mounted on the chucked discs, wherein the discs with the pairs of nozzles and the water receiving cover mounted rotate about the respective centers thereof in response to rotation of the disc chuck mechanism, and are supplied with the hot water from the pairs of nozzles; and the hot water flows from the inner peripheral surfaces to the outer peripheries of the discs by centrifugal force to be outwardly discharged, the discharged hot water flowing through the valley grooves to be discharged to the outside from an opened side surface of the water receiving cover.

2. The disc drying device according to claim 1, further comprising an advancing/retreating mechanism, as a member for removably mounting the pairs of nozzles and the water receiving cover on the chucked discs, for relatively advancing and retreating the pairs of nozzles and the water receiving cover along the single axis with respect to the chucked discs, wherein the advancing/retreating mechanism mounts and removes the pairs of nozzles and the water receiving cover on and from the discs;

the pairs of nozzles and the water receiving cover are retracted outside of a location of the discs when removed from the discs; and the water receiving cover includes a portion opened below the erected discs.

3. The disc drying device according to claim 2, further comprising a rotating mechanism for rotating the disc chuck mechanism about the centers of the discs, wherein each of the valley grooves is a V-shaped groove, and fins for preventing water from dripping are provided on both sides of an upper surface of the valley groove.

4. The disc drying device according to claim 3, wherein the pairs of nozzles are fixed to and supported by a side opposite to a side facing the disc chuck mechanism in the water receiving cover to be advanced and retreated integrally with the water receiving cover by the advancing/retreating mechanism.

5. The disc drying device according to claim 4, wherein the disc chuck mechanism includes a first disc chuck mechanism and a second disc chuck mechanism, the first and second disc chuck mechanisms being provided on a turning table provided along a direction perpendicular to the single axis, at a predetermined angle with respect to a rotation center of the turning table, along the single axis;

the turning table is rotated to thereby cause the first and second disc chuck mechanisms to face alternately the retracted pairs of nozzles and water receiving cover, so that the pairs of nozzles and the water receiving cover are mounted on the discs; and the chucked discs are unloaded from the disc chuck mechanism located on a side not facing the pairs of nozzles and the water receiving cover, out of the first and second disc chuck mechanisms, or loaded on the disc chuck mechanism after this unloading.

6. A disc drying method for spin-drying a disc having a central opening, comprising the steps of:

simultaneously chucking, with a disc chuck mechanism, outer peripheries of a plurality of the discs erected with respective centers of the discs arranged along a single axis, leaving a predetermined space therebetween;

externally and removably covering the plurality of chucked discs with a cylindrical water receiving cover with valley grooves being formed circumferentially in a plane perpendicular to the cylindrical axis in an inner wall surface of the water receiving cover;

inserting a plurality of pairs of nozzles, in a removable manner with respect to the discs, into a space formed by the central openings of the chucked discs, and placing each of the pairs of nozzles corresponding to two sides of an inner peripheral surface adjacent to the central opening of each of the discs;

rotating the disc chuck mechanism to rotate, about the centers of the discs, the discs with the pairs of nozzles and the water receiving cover mounted, and supplying hot water from the pairs of nozzles to heat the chucked discs;

causing the hot water to flow from the inner peripheral surfaces to the outer peripheries of the discs by centrifugal force and to be outwardly discharged; and causing the discharged hot water to flow through the valley grooves and to be discharged to the outside from the water receiving cover.

7. The disc drying method according to claim 6, further comprising the step of relatively advancing and retreating the pairs of nozzles and the water receiving cover along the single axis with respect to the chucked discs, with an advancing/retreating mechanism as a member for removably mounting the pairs of nozzles and the water receiving cover on the chucked discs, wherein the advancing/retreating mechanism mounts and removes the pairs of nozzles and the water receiving cover on and from the discs;

the pairs of nozzles and the water receiving cover are retracted outside of a location of the discs when removed from the discs; and the water receiving cover includes a portion opened below the erected discs.

8. The disc drying method according to claim 7, further comprising the step of rotating the disc chuck mechanism about the centers of the discs with a rotating mechanism, wherein each of the valley grooves is a V-shaped groove, and fins for preventing water from dripping are provided on both sides of an upper surface of the valley groove.

9. The disc drying method according to claim 8, wherein the pairs of nozzles are fixed to and supported by a side opposite to a side facing the disc chuck mechanism in the water receiving cover to be advanced and retreated integrally with the water receiving cover by the advancing/retreating mechanism.

10. The disc drying method according to claim 9, wherein the disc chuck mechanism includes a first disc chuck mechanism and a second disc chuck mechanism, the first and second disc chuck mechanisms being provided along the single axis at a predetermined angle with respect to a rotation center of a turning table, the turning table being provided along a direction perpendicular to the single axis;

the turning table is rotated to thereby cause the first and second disc chuck mechanisms to face alternately the retracted pairs of nozzles and water receiving cover, so that the pairs of nozzles and the water receiving cover are mounted on the discs; and the chucked discs are unloaded from the disc chuck mechanism located on a side not facing the pairs of nozzles and the water receiving cover, out of the first and second disc chuck mechanisms, or loaded on the disc chuck mechanism after this unloading.

* * * * *